US008181949B2

(12) United States Patent
Hung

(10) Patent No.: US 8,181,949 B2
(45) Date of Patent: May 22, 2012

(54) MICRO-ADJUSTABLE PARALLEL BENCH VISE

(76) Inventor: Yi-Po Hung, Taichung County (TW)

( * ) Notice: Subject to any disclaimer, the term of this patent is extended or adjusted under 35 U.S.C. 154(b) by 429 days.

(21) Appl. No.: 12/471,469

(22) Filed: May 25, 2009

(65) Prior Publication Data

US 2010/0295227 A1 Nov. 25, 2010

(51) Int. Cl.
*B25B 1/10* (2006.01)
*B25B 1/24* (2006.01)

(52) U.S. Cl. ..... 269/244; 269/43; 269/291; 269/289 R; 269/45; 269/290; 269/309; 269/310; 269/312; 269/313; 269/285

(58) Field of Classification Search ..... 269/244, 269/43, 291, 289 R, 45, 290, 309, 310, 312, 269/313
See application file for complete search history.

(56) References Cited

U.S. PATENT DOCUMENTS

| | | | | | |
|---|---|---|---|---|---|
| 1,430,226 | A * | 9/1922 | Goodreau | 269/27 |
| 2,949,939 | A * | 8/1960 | Milla | 140/115 |
| 4,438,911 | A * | 3/1984 | McDougal | 269/32 |
| D287,457 | S * | 12/1986 | Listes | D8/74 |
| 4,757,614 | A * | 7/1988 | Kudlacek | 33/265 |
| 4,927,126 | A * | 5/1990 | Hoffman | 269/60 |
| 5,975,513 | A * | 11/1999 | Wolfe | 269/136 |
| 6,079,704 | A * | 6/2000 | Buck | 269/242 |
| 6,202,997 | B1 * | 3/2001 | Yasuda | 269/212 |
| 7,134,650 | B2 * | 11/2006 | Trudel et al. | 269/138 |

* cited by examiner

*Primary Examiner* — Monica Carter
*Assistant Examiner* — Melanie Alexander
(74) *Attorney, Agent, or Firm* — Pai Patent & Trademark Law Firm; Chao-Chang David Pai

(57) ABSTRACT

A micro-adjustable parallel bench vise includes a slide holder having a top dovetail rail, a vise body having a bottom dovetail groove coupled to the dovetail rail of the slide holder and holding a fixed jaw member, a screw holder slidably mounted in the top side of the vise body, a screw rod threaded into the screw holder and rotatable to move the screw holder relative to the vise body. When multiple vise bodies are mounted on the slide holder in parallel, they are micro-adjustable to hold a workpiece or multiple workpieces precisely in position.

7 Claims, 13 Drawing Sheets

MICRO-ADJUSTABLE PARALLEL BENCH VISE

BACKGROUND OF THE INVENTION (a) Field of the Invention

The present invention relates to a bench vise and more particularly to a micro-adjustable parallel bench vise, which allows micro-adjustment of the positions of multiple vises on one slide holder.

(b) Description of the Prior Art

A conventional parallel bench vise, as shown in FIGS. 1 and 2, includes a rack 10 having a series of teeth 101, a fixed jaw member 20 having a series of teeth 201 on its top side, a slope 202 on its one end and a clamping face 203 on its opposite end, a movable jaw member 30 having a slope 301 on its one end and a clamping face 302 on its opposite end, and a wedge block 40 set in between the slope 202 of the fixed jaw member 20 and the slope 301 of the movable jaw member 30. When forcing the wedge block 40 downwards, the movable jaw member 30 is moved along the rack 10 to clamp a workpiece 50.

According to the aforesaid prior art design, the teeth 101 of the rack 10 are meshed with the teeth 201 of the fixed jaw member 20. Theoretically, the pitch of the teeth 101 and the pitch of the teeth 201 must get the same precision. However, in actual practice, it is difficult to have the pitch of the teeth 101 and the pitch of the teeth 201 get the same precision. When multiple fixed jaw members 20, movable jaw members 30 and wedge blocks 40 are joined to parallel racks 10 for application, an error in coordinates will be inevitable. However, due to the limitation of minimum pitch of the teeth 101 and 201 (see P in FIG. 2), forward/backward micro-adjustment is not allowed. This is the major drawback of the aforesaid prior art design. Further, this prior art design uses the wedge block 40 to move the movable jaw member 30 in producing a clamping force. This clamping force is small. Further, the stroke of the movable jaw member 30 is short. Further, as shown in FIG. 1, a pad 60 must be added to the bottom side of the workpiece 50 during application, therefore it is difficult to keep the workpiece 50 in balance. Further, when forcing the wedge block 40 to move the movable jaw member 30, the movable jaw member 30 may be tilted. At this time, as shown in FIG. 3, the workpiece 50 tends to be biased, affecting workpiece processing precision.

SUMMARY OF THE INVENTION

The present invention has been accomplished in view of these circumstances. It is one object of the present invention to provide a micro-adjustable parallel bench vise, which allows micro-adjustment of the position of multiple vises on one slide holder subject to the design of a dovetail rail on the slide holder and a dovetail groove on the vise body of each vise, achieving precision clamping.

It is another object of the present invention to provide a micro-adjustable parallel bench vise, which, by means of its simple structural design, eliminates the drawbacks of low clamping force of movable jaw member, short jaw stroke and easy tilting of the prior art design.

DETAILED DESCRIPTION OF THE PREFERRED EMBODIMENTS

Figure 1:
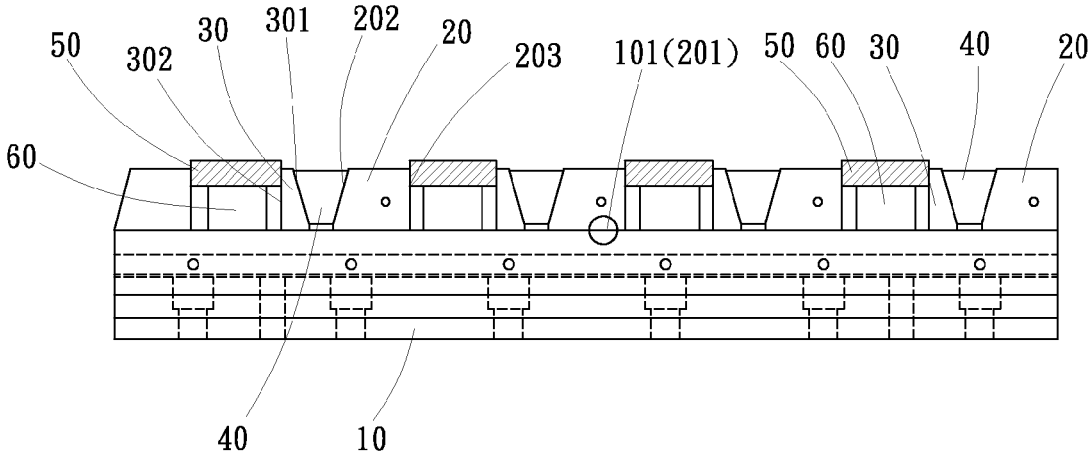
FIG. 1 PRIOR ART
FIG. 1 is a schematic side view of a parallel bench vise according to the prior art.
Figure 2:
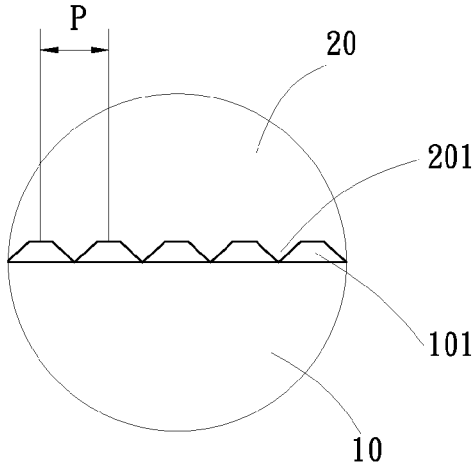
FIG. 2 PRIOR ART
FIG. 2 is an enlarged view of a part of FIG. 2, showing engagement between the teeth of the rack and the teeth of the fixed jaw member.
Figure 3:
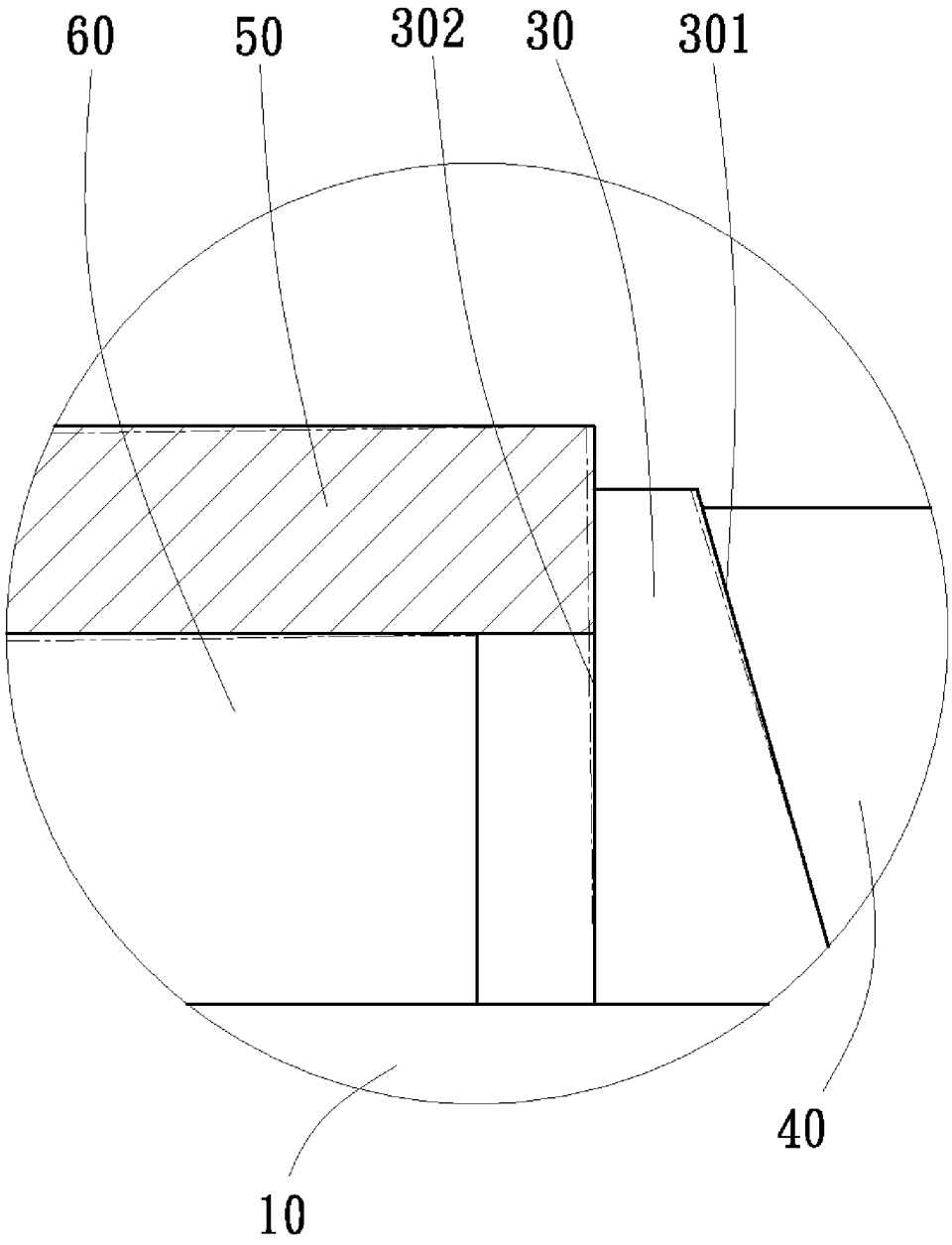
FIG. 3 PRIOR ART
FIG. 3 is a schematic drawing of the prior art design, showing the workpiece tilted.

Referring to the annexed drawings in detail, a micro-adjustable parallel bench vise in accordance with the present invention is shown comprising a slide holder 1, a vise body 2, a screw holder 3, a screw rod 4, a fixed jaw member 5 and a movable jaw member 6.

Figure 4:
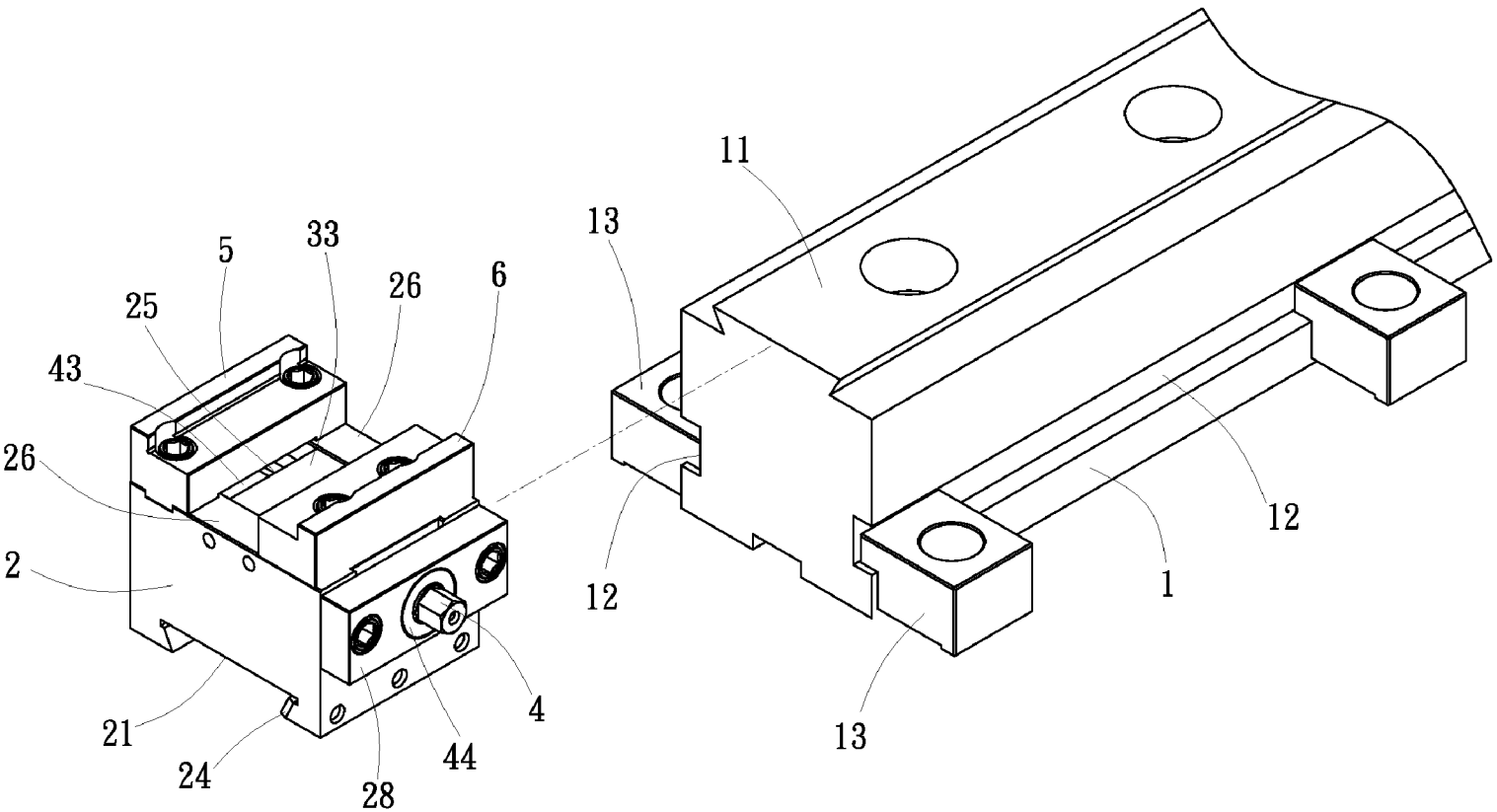
FIG. 4 is an exploded view of a slide holder and one vise of a parallel bench vise according to the present invention.
Figure 5:
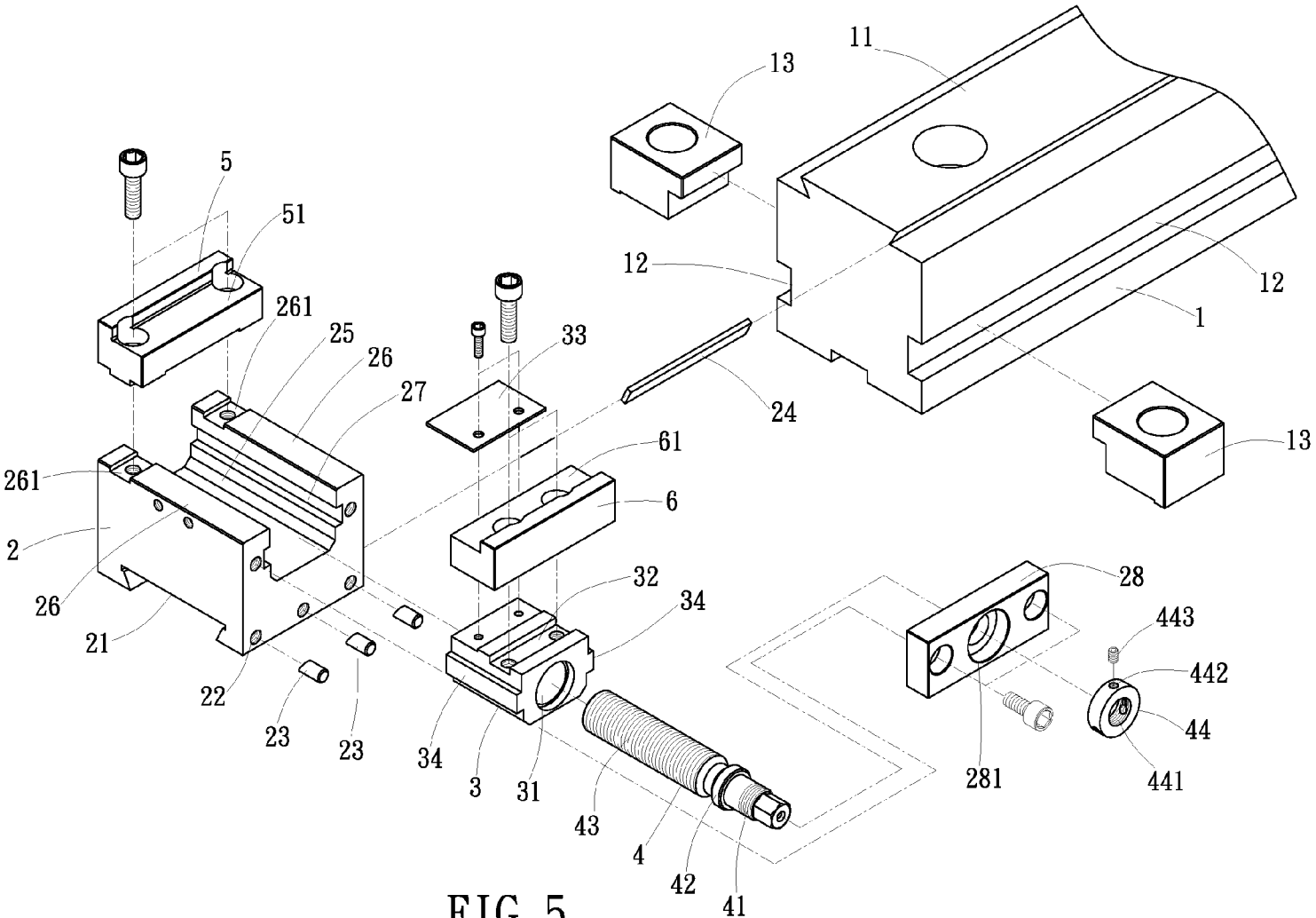
FIG. 5 is an exploded view of FIG. 4.
Figure 6:
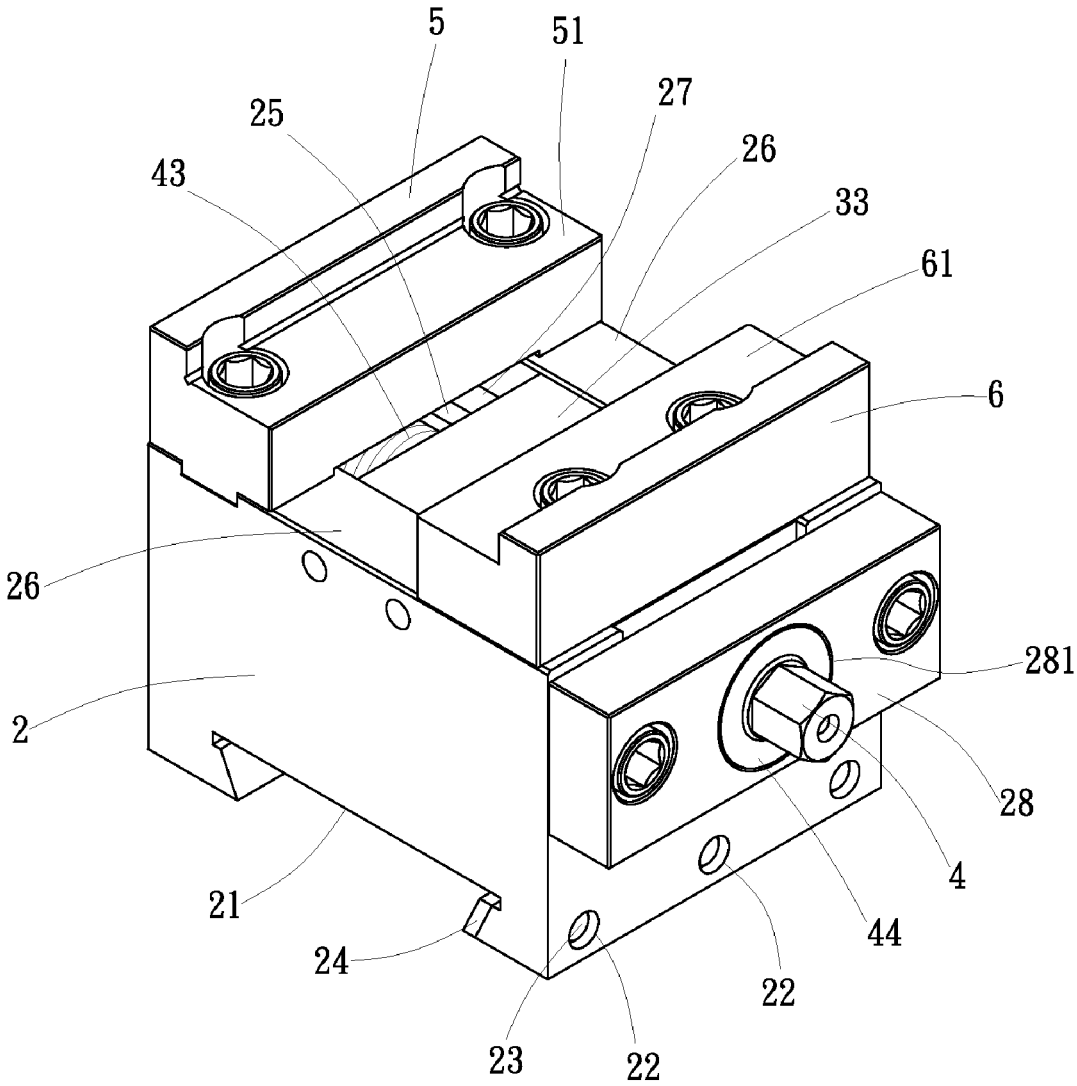
FIG. 6 is an elevational view of one vise of the parallel bench vise according to the present invention.
Figure 7:
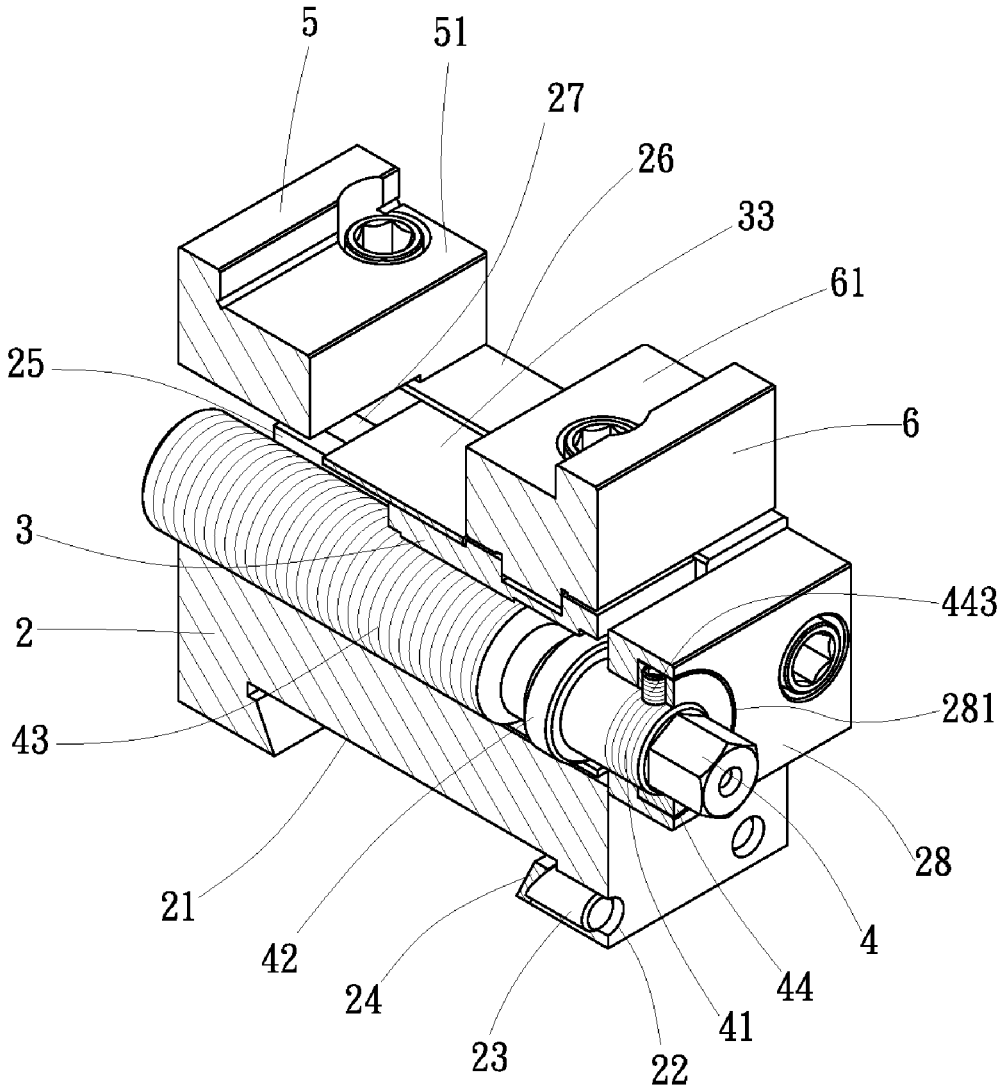
FIG. 7 is a sectional elevation of one vise of the parallel bench vise according to the present invention.
Figure 8:
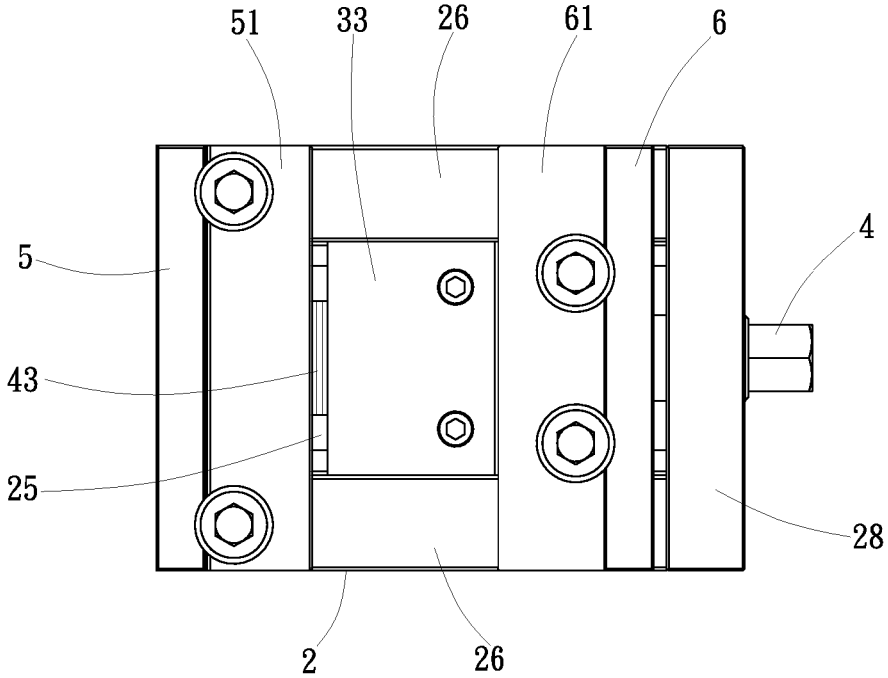
FIG. 8 is a top plain view of the vise shown in FIG. 6.
Figure 9:
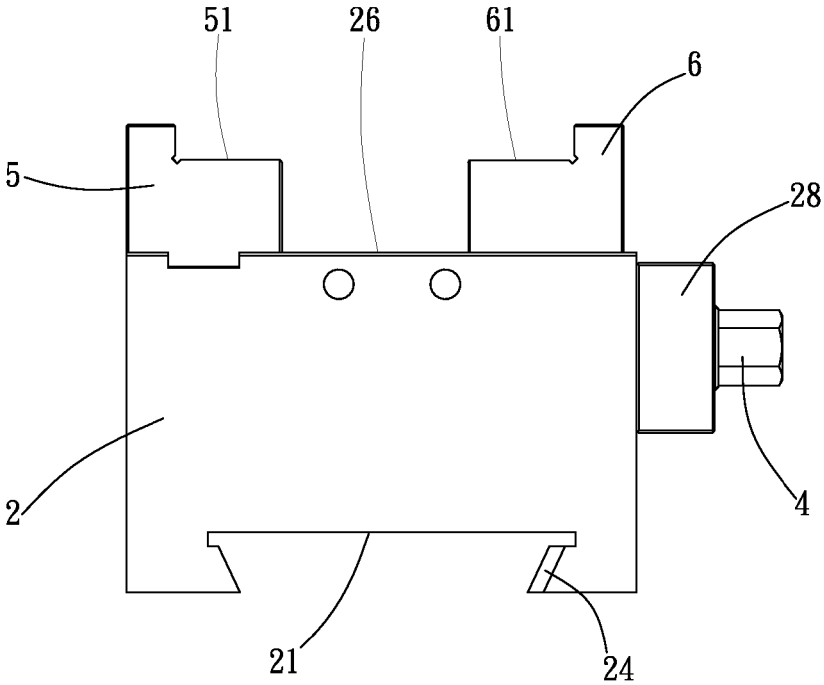
FIG. 9 is a side plain view of the vise shown in FIG. 6.

The slide holder 1, as shown in FIGS. 4 and 5, is an elongated rectangular block having a dovetail rail 11 located on the top side thereof and two coupling grooves 12 arranged at two opposite lateral sides thereof in parallel. Two angled pressure blocks 13 are respectively coupled to the coupling grooves 12 and affixed to a worktable or other equipment to hold the slide holder 1 in place.

Figure 11:
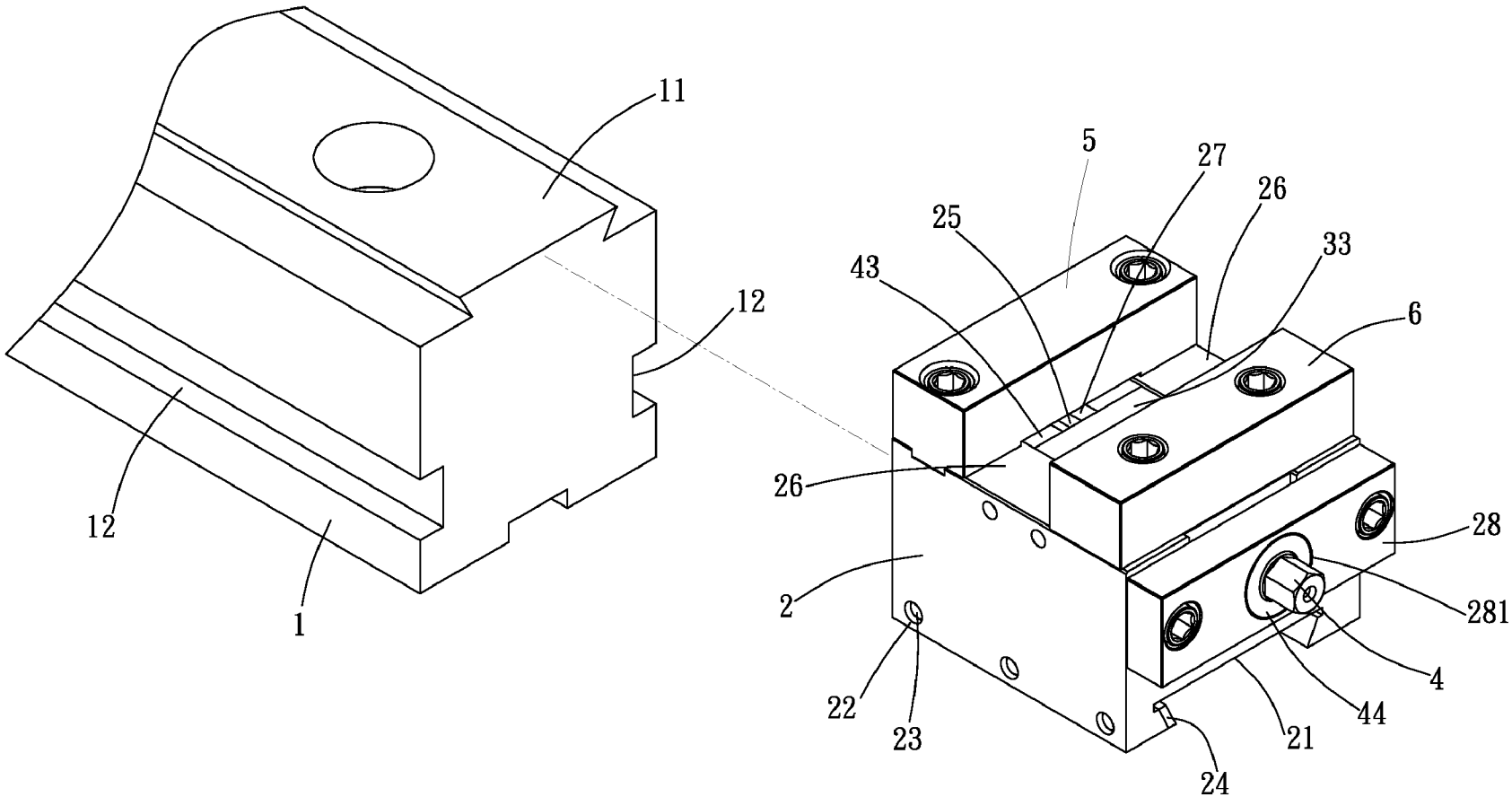
FIG. 11 is an exploded view of a part of the present invention, showing an alternate form of the dovetail groove on the vise body.

The vise body 2, as shown in FIGS. 4~9, has a dovetail groove 21 located on the bottom side thereof and coupled to the dovetail rail 11 of the slide holder 1. The extending direction of the dovetail groove 21 and the extending direction of the screw rod 4 can be arranged at right angles. Alternatively, the extending direction of the dovetail groove 21 and the extending direction of the screw rod 4 can be arranged in a parallel manner (see FIG. 11). A wedge strip 24 is attached to one sidewall of the dovetail groove 21 so that the dovetail groove 21 can be joined to and positioned on the dovetail rail 11. The vise body 2 further has a plurality of screw holes 22 each of which receives a respective locating device 23, a recessed portion 25 located on the top side, two sliding grooves 27 symmetrically arranged at two opposite lateral sides in the recessed portion 25, and two sliding rails 26 symmetrically arranged at two opposite lateral sides above the sliding grooves 27. Each sliding rail 26 has a locating notch 261 near one side. A bearing plate 28 is affixed to one end of the recessed portion 25 of the vice body 2, having a stepped through hole 281 for supporting the screw rod 4.

The screw holder 3, as shown in FIGS. 4 and 5, is a slid block member having a screw hole 31 extending through front and rear sides thereof, a locating groove 32 located on the top side thereof, a dust cover 33 covered on the top side over the locating groove 32, and two siding rails 34 respectively protruded from the two opposite lateral sidewalls thereof and respectively coupled to the sliding grooves 27 in the recessed portion 25 of the vise body 1.

The screw rod 4, as shown in FIGS. 4 and 5, is rotatably inserted through the stepped through hole 281 of the bearing plate 28 at one end of the recessed portion 25 of the vice body 2 and threaded into the screw hole 31 of the screw holder 3. Therefore, when rotating the screw rod 4, the screw holder 3 is forced to move forwards or backwards along the sliding grooves 27 in the recessed portion 25 of the vise body 1. According to the present preferred embodiment, the screw rod 4 has a main thread section 43 at one end, a supplementary thread section 41 at the other end, and a stop flange 42 extending around the periphery and spaced between the main thread section 43 and the supplementary thread section 41. A stop ring 44 is mounted in the stepped through hole 281 of the bearing plate 28, having an axial center screw hole 441 threaded onto the supplementary thread section 41 of the screw rod 4, a plurality of radial screw holes 442 radially extended from the axial center screw hole 441 to the periphery and equiangularly spaced from one another, and a plurality of positioning screws 443 respectively threaded into the radial screw holes 442 and meshed with the supplementary thread section 41 of the screw rod 4 (see FIG. 7). After installation of the stop ring 44 and the screw rod 4, the stop flange 42 is stopped against the inner side of the bearing plate 28, and the main thread section 43 of the screw rod 4 is kept in mesh with the screw hole 31 of the screw holder 3.

Figure 10:
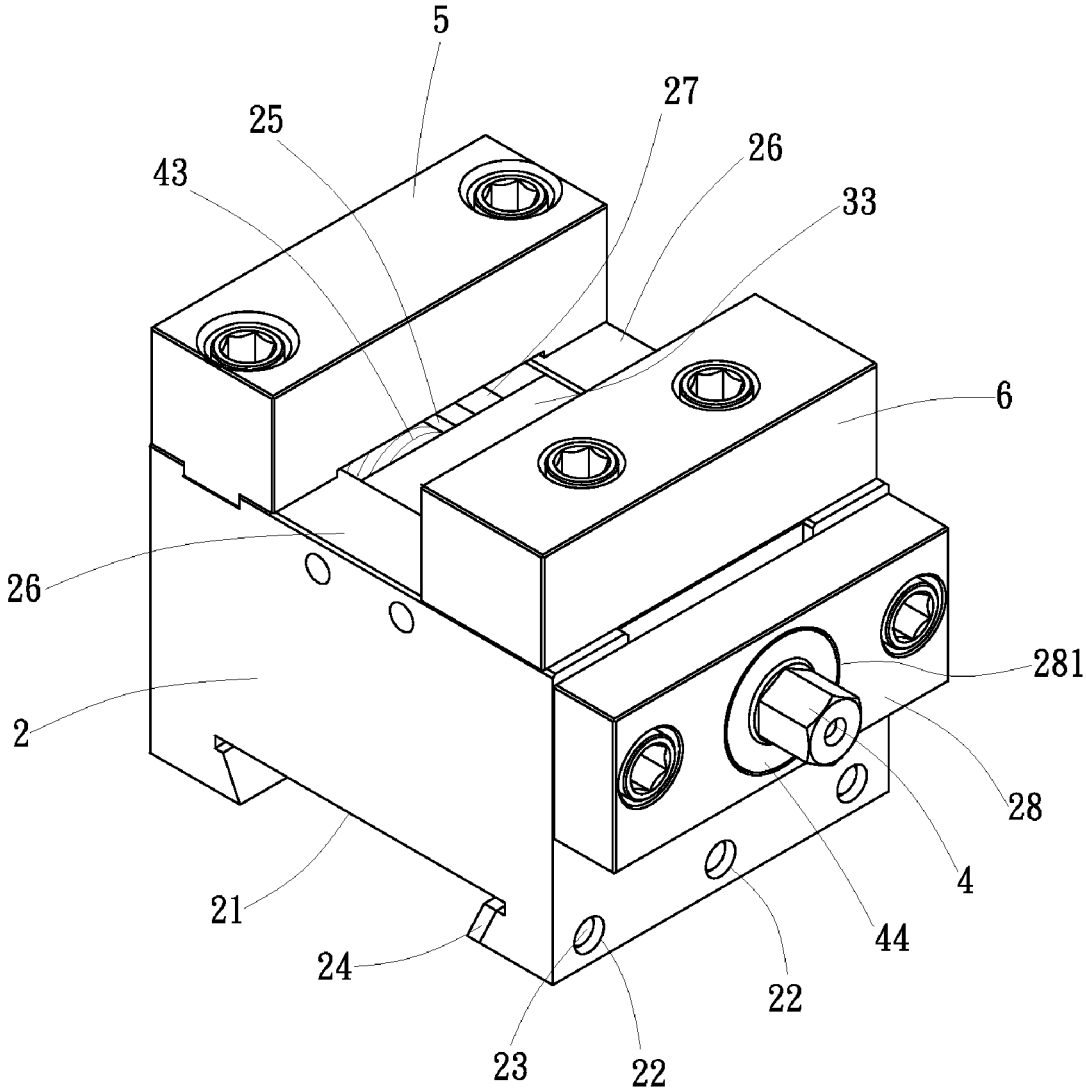
FIG. 10 is similar to FIG. 6, showing an alternate form of the fixed jaw member and the movable jaw member.

The fixed jaw member 5, as shown in FIGS. 4~9, has a step 51 located on the top side thereof. The bottom side of the fixed jaw member 5 is fastened to the locating notches 261 of the sliding rails 26 of the vise body 2. Further, as shown in FIG. 10, the fixed jaw member 5 can be made in the shape of a rectangular block without the aforesaid step 51.

The movable jaw member 6, as shown in FIGS. 4~9, has a step 61 located on the top side thereof. The bottom side of the movable jaw member 6 is fastened to the locating groove 32 of the screw holder 3. Further, as shown in FIG. 10, the movable jaw member 6 can be made in the shape of a rectangular block without the aforesaid step 61.

Figure 12:
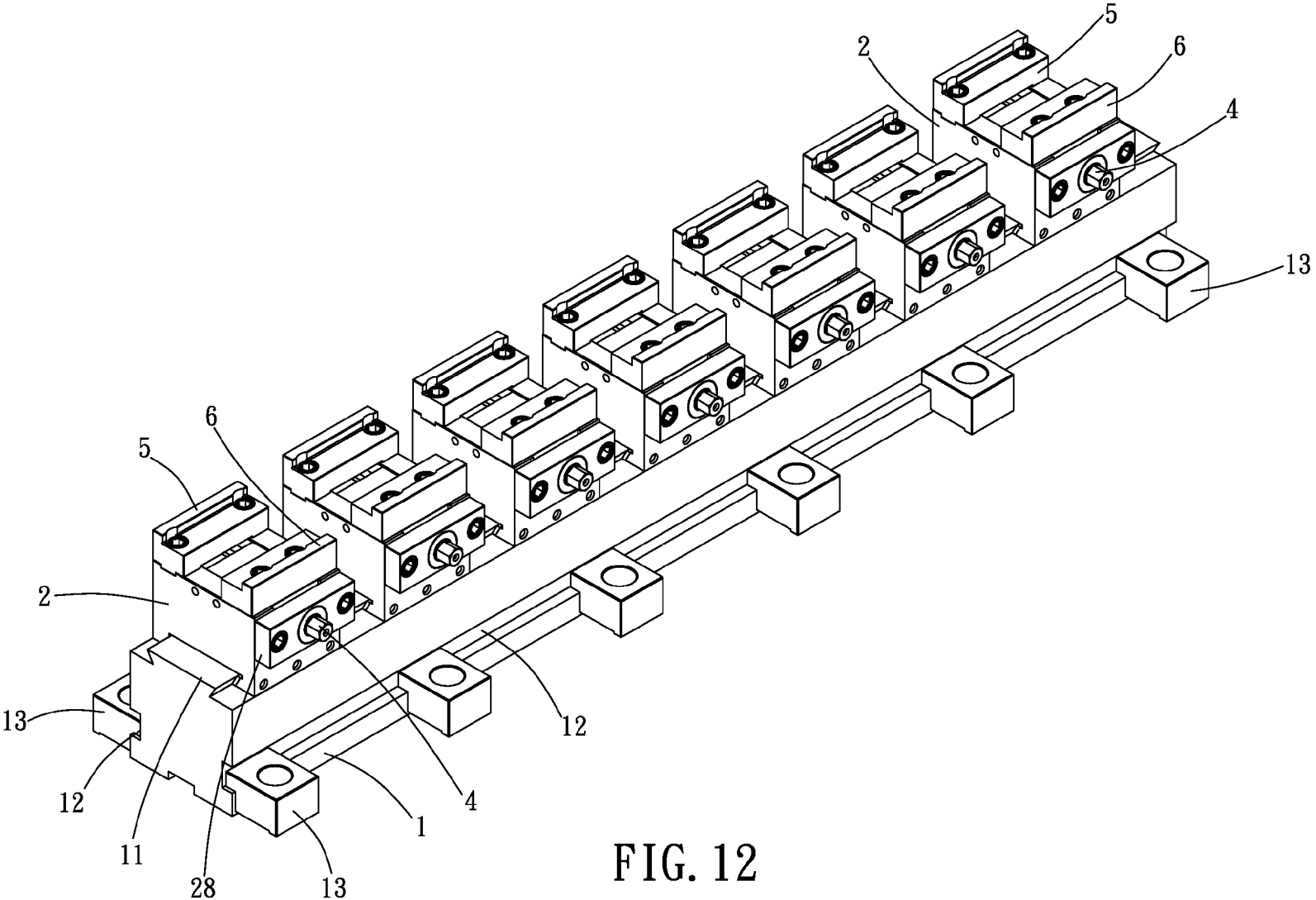
FIG. 12 is a schematic drawing, showing one application example of the present invention.
Figure 13:
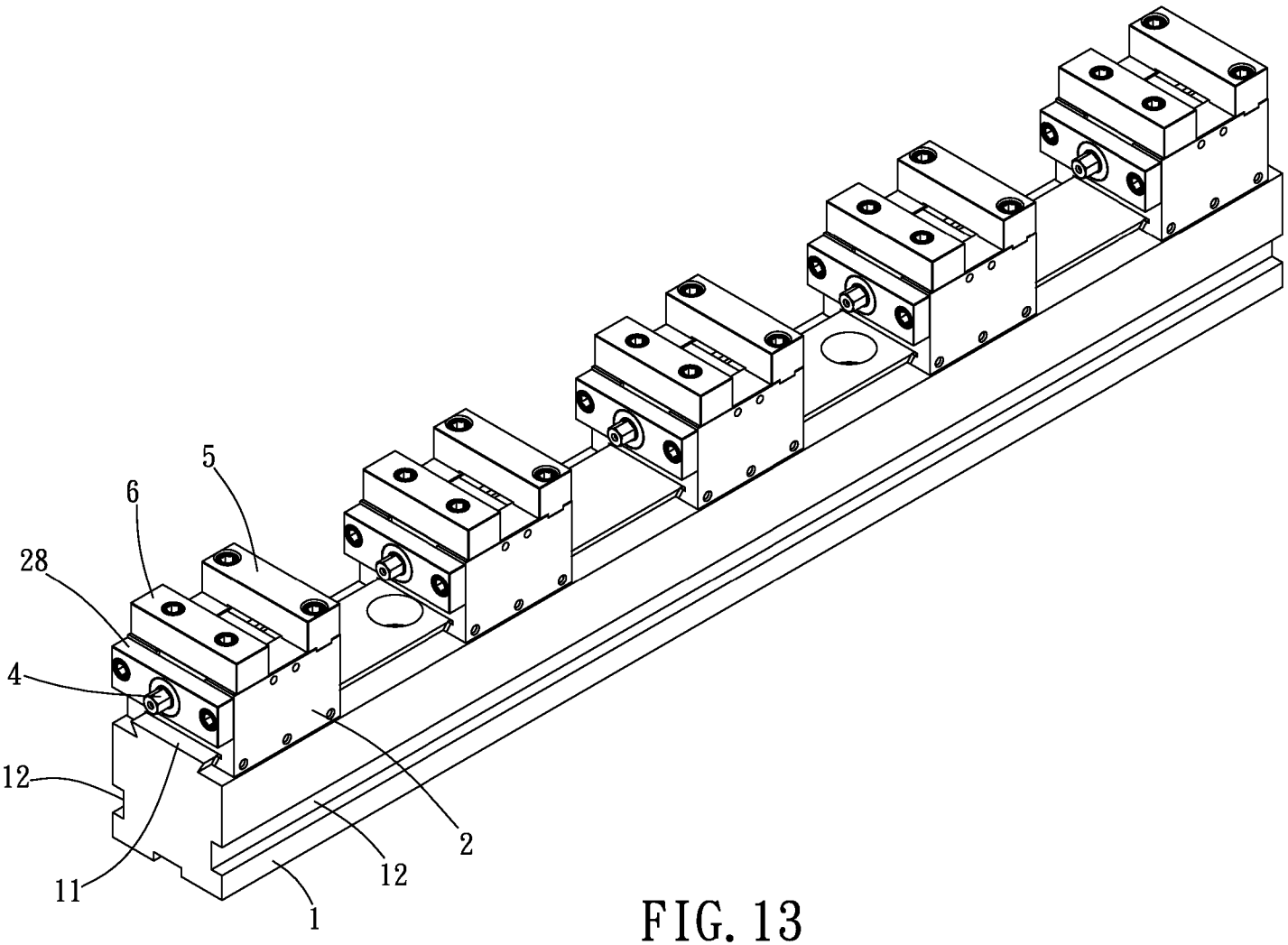
FIG. 13 is a schematic drawing, showing another application example of the present invention.
Figure 14:
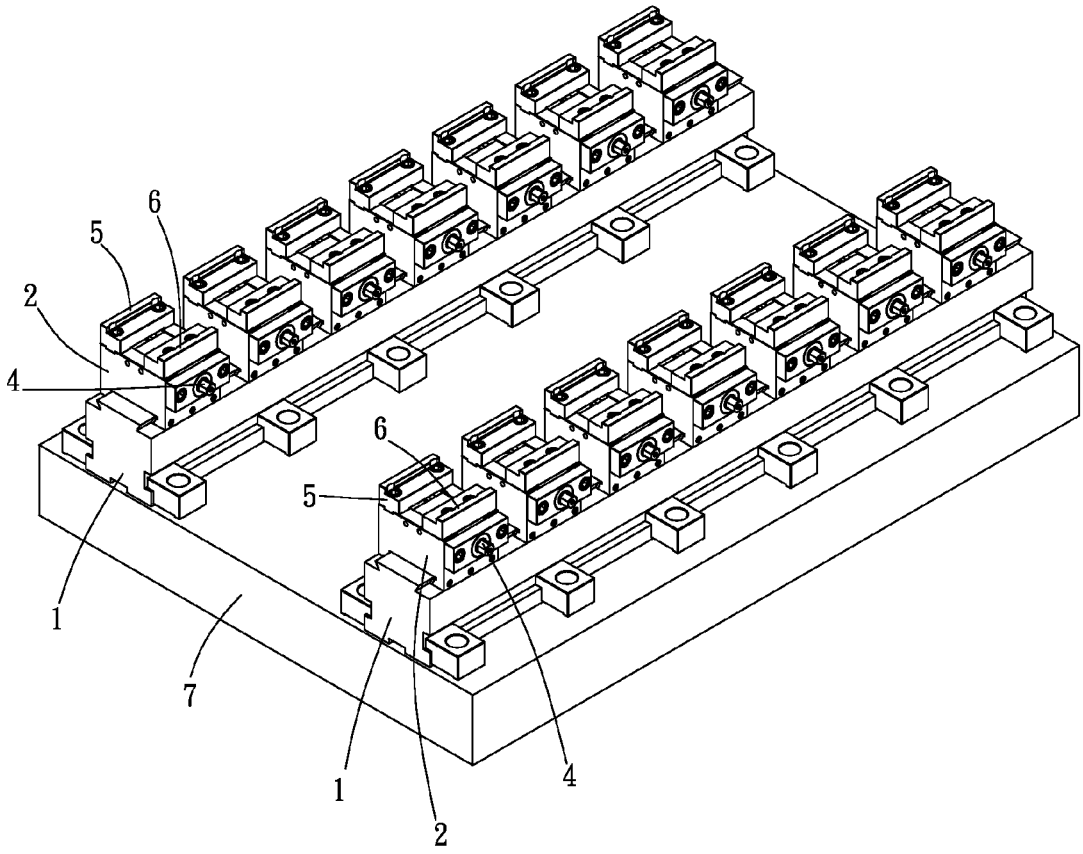
FIG. 14 is a schematic drawing, showing still another application example of the present invention.

During application of the micro-adjustable parallel bench vise, as shown in FIGS. 12 and 13, the dovetail groove 21 of the vise body 2 is coupled to the dovetail rail 11 of the slide holder 1. Thus, a number of vises can be conveniently mounted on the slide holder 1 in a parallel manner to hold a workpiece (it is to be understood that a vise consists of one vise body 2, one screw holder 3, one screw rod 4, one fixed jaw member 5 and one movable jaw member 6). Further, as shown in FIG. 14, multiple slide holders 1 each carrying multiple vises can be arranged on a bench 7 in a parallel manner or around a mold to hold multiple workpieces or a single workpiece.

Figure 15:
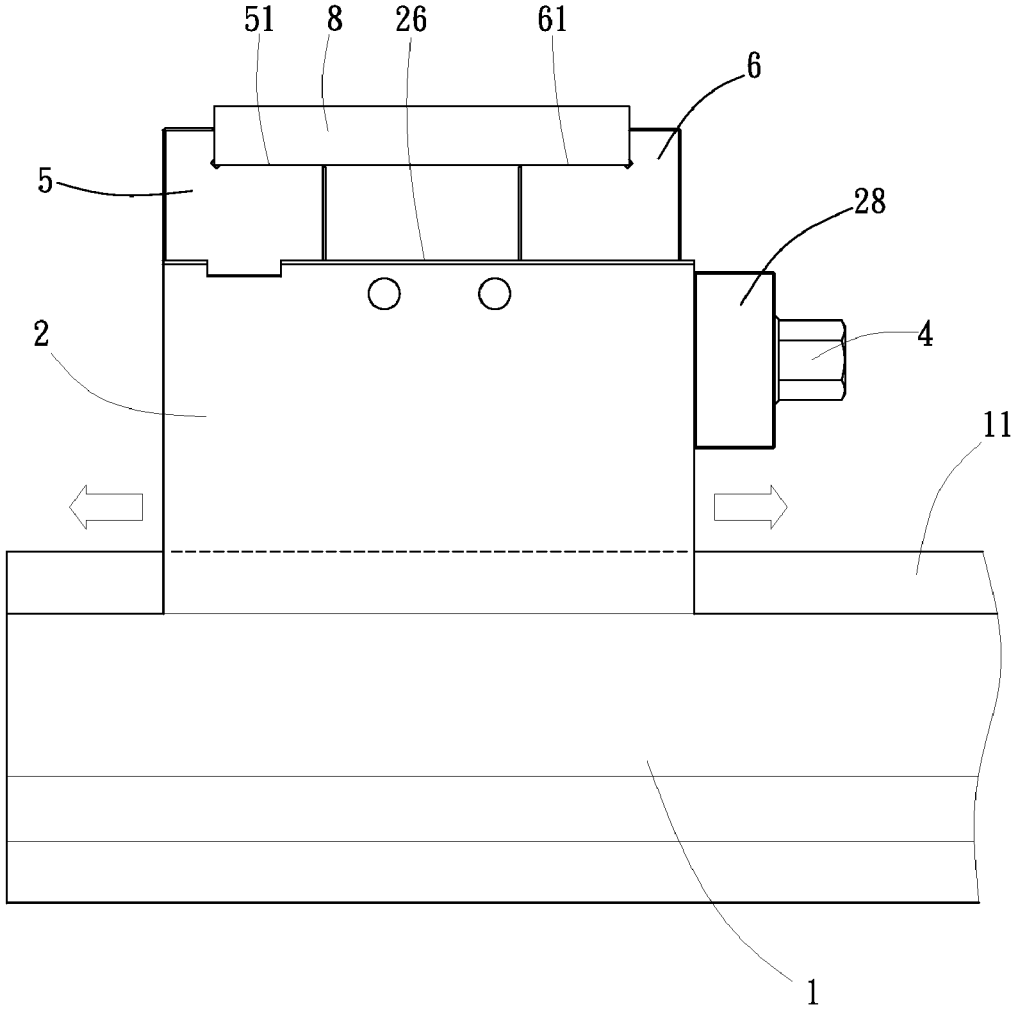
FIG. 15 is a schematic drawing, showing a small workpiece clamped between the step of the movable jaw member and the step of the fixed jaw member.

The main feature of the present invention is that the coordinate vise body 2 is micro-adjustable on the slide holder 1, eliminating the adjustment problem of tooth pitch limitation of the prior art parallel bench vise. When multiple slide holders 1 are arranged in parallel for application, as shown in FIGS. 14 and 15, multiple vises can be adjusted to the same coordinates, holding the workpieces with equal precision. Further, the invention uses the screw rod 4 to move the screw holder 3 and the movable jaw member 6, to enable the fixed jaw member 5 and the movable jaw member 6 to hold the workpiece. The workpiece clamping force and stability of the micro-adjustable parallel bench vise according to the present invention are better than the prior art design. Further, the movable jaw member 6 obtains a relatively greater stroke, facilitating position adjustment subject to the size of the workpiece to be clamped. Further, as shown in FIG. 15, the step 51 of the fixed jaw member 5 and the step 61 of the movable jaw member 6 are practical for clamping a small or thin workpiece 8 firmly in position, achieving precision clamping.

A prototype of the micro-adjustable parallel bench vise has been constructed with the features of FIGS. 4~15. The micro-adjustable parallel bench vise functions smoothly to provides all of the features disclosed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A micro-adjustable parallel bench vise, comprising:

a slide holder, said slide holder having a dovetail rail on a top side thereof;

a vise body, said vise body having a bottom dovetail groove coupled to said dovetail rail of said slide holder, a top recessed portion, and two sliding rails disposed at two opposite lateral sides of said top recessed portion;

a screw holder slidably mounted in said top recessed portion of said vise body, said screw holder having a screw hole extending through front and rear sides thereof;

a screw rod threaded into said screw hole of said screw holder in said top recessed portion of said vise body and rotatable to move said screw holder relative to said vise body;

a fixed jaw member affixed to the sliding rails of said vise body at one end; and a movable jaw member mounted on said screw holder, wherein said vise body has a bearing plate fixedly mounted on one end of said top recessed portion, said bearing plate having a stepped through hole; said screw rod has a first end thereof rotatably supported in the stepped through hole of said bearing plate and a second end thereof threaded into the screw hole of said screw holder; and said screw rod has a supplementary thread section at the first end inserted through the stepped through hole of said bearing plate and rotatably secured thereto by a stop ring mounted in the stepped through hole and a plurality of positioning screws, a main thread section at the second end, and a stop flange extending around the periphery thereof and spaced between said supplementary thread section and said main thread section and stopped against an inner side of said bearing plate, said stop ring having an axial center screw hole threaded onto said supplementary thread section of said screw rod and a plurality of radial screw holes, said positioning screws being respectively threaded into said radial screw holes of said stop ring and meshed with said supplementary thread section of said screw rod.

2. The micro-adjustable parallel bench vise as claimed in claim 1, wherein said slide holder has two coupling grooves symmetrically located on two opposite lateral sides thereof, and two pressure blocks respectively coupled to said coupling grooves.

3. The micro-adjustable parallel bench vise as claimed in claim 1, wherein said dovetail groove of said vise body is extended in a direction perpendicular to the length of said screw rod.

4. The micro-adjustable parallel bench vise as claimed in claim 1, wherein said dovetail groove of said vise body is extended in a direction parallel to the length of said screw rod.

5. The micro-adjustable parallel bench vise as claimed in claim 1, wherein said fixed jaw member and said movable jaw member each have a top step, and the two top steps define a space above the top steps for holding a workpiece of a different width than a space below the top steps.

6. The micro-adjustable parallel bench vise as claimed in claim 1, wherein said fixed jaw member and said movable jaw member are rectangular block members.

7. The micro-adjustable parallel bench vise as claimed in claim 1, wherein said vise body is slidably supported on said slide holder.

* * * * *